United States Patent [19]

Dunford et al.

[11] Patent Number: 4,698,851

[45] Date of Patent: Oct. 13, 1987

[54] SKI GLOVE

[75] Inventors: Scott V. Dunford, Salt Lake; Ryan S. Daw, Draper, both of Utah

[73] Assignee: Skiears, Inc., Salt Lake City, Utah

[21] Appl. No.: 926,001

[22] Filed: Oct. 31, 1986

[51] Int. Cl.[4] ..... A41D 19/00

[52] U.S. Cl. ..... 2/160; 2/161 A

[58] Field of Search ..... 2/158, 159, 160, 161 R, 2/161 A, 163

[56] References Cited

U.S. PATENT DOCUMENTS

| | | | |
|---|---|---|---|
| 792,662 | 6/1905 | Liebenstein | 2/161 R |
| 922,237 | 5/1909 | Baggett | 2/161 R |
| 945,818 | 1/1910 | Sprague | 2/161 R |
| 2,581,549 | 1/1952 | McGaugh | 2/161 R |
| 3,170,703 | 2/1965 | Marchand | 2/160 X |
| 3,232,632 | 2/1966 | Lewis | 2/160 X |
| 4,081,864 | 4/1978 | Liman | 2/161 A |
| 4,653,121 | 3/1987 | Kassal | 2/161 A |

*Primary Examiner*—Louis K. Rimrodt

*Attorney, Agent, or Firm*—Thorpe, North & Western

[57] ABSTRACT

A glove covering for use in winter sports for protecting a hand against cold weather, comprising an outer glove shell which includes a finger section, thumb section and palm/wrist section. Pocket members are attached at the finger and thumb sections to allow insertion of a user's fingers and thumbs within the pockets. The palm/wrist section of the shell is open and without any pocket structure to facilitate firm grip by the user's hand around a ski pole or other article being grasped in the hand of the user.

12 Claims, 4 Drawing Figures

SKI GLOVE

BACKGROUND OF THE INVENTION

1. Field of the Invention:

This invention relates to cold weather gloves for providing protection to the hands against adverse weather conditions. More particularly, the invention pertains to an exterior glove adapted for use over a conventional glove to increase the degree of insulation and protection to the hand.

2. Prior Art:

A variety of glove designs have been developed for protecting the hands in cold weather sports. Typical of the more extreme conditions is the sport of skiing. Because the hands are used during skiing activities, the glove represents the only protection against cold weather. Such cold weather conditions do not remain uniform, but vary even during the course of the day.

During early morning hours when cold weather conditions are most severe, even the best of gloves may be inadequate to protect the hands. As the day warms up, however, the same pair of gloves will be adequate, or may even be too warm. In such cases, the skier must decide whether to return to the lodge and change cloves, to remove the gloves and go without, or to continue to wear the gloves and be too warm. Typically, a skier finds it too cumbersom to carry more than one pair of gloves, despite the fact that he would be more comfortable if he were able to change to a lighter weight glove as the day progresses.

OBJECTS AND SUMMARY OF THE INVENTION

It is therefore an object of the present invention to provide a type of ski glove which can be worn in combination with other ski gloves as a second covering, but which are small enough to allow easy storage in a coat pocket during warmer weather when a single pair of gloves is adequate.

It is a further object of the present invention to provide a glove covering which does not significantly increase the thickness of material between the user's hand and the hand-held sporting equipment, such as a ski pole.

It is a still further object of this invention to provide an outer glove shell which adds warmth when used with an inner full glove without significantly adding to the bulk of the full glove.

A still further object of the present invention is to provide a glove covering which may also be used without an interior full glove to protect the hands from mildly cold weather.

Yet another object of the present invention is to provide a glove device which provides protection against cold weather when the hand is formed in a fist, but allows partial exposure of the hand in an open configuration to provide ventillation.

These and other objects are provided in a glove covering for use in winter sports which comprises an outer glove shell, at least one first pocket member for fingers and a second pocket member for the thumb. The outer glove shell is configured in size and shape to fully cover only a back side of the hand and has a length extending from a forward fingertip end to a rearward wrist end. The outer glove shell includes at least one finger section, a palm/wrist section and a thumb section. At least one pocket member is configured in the approximate shape of the finger section and is joined therewith to form a pocket having an opening accessible from the palm/wrist section for insertion of fingers of the hand.

A second pocket member formed in the approximate configuration of the thumb section of the glove shell is attached around the perimeter thereof with an unattached section at the approximate juncture of the palm/wrist and thumb sections to form a pocket opening for the thumb. The palm/wrist section of the shell is an open face without any pocket structure and provides protection to the back of the hand. A strap may be attached to the shell for coupling to a ski pole. Other modifications are also disclosed.

Other objects and features of the present invention will be apparent to those skilled in the art, based on the following detailed description, taken in combination with the following drawings, wherein.

DETAILED DESCRIPTION OF THE INVENTION

Figure 1:
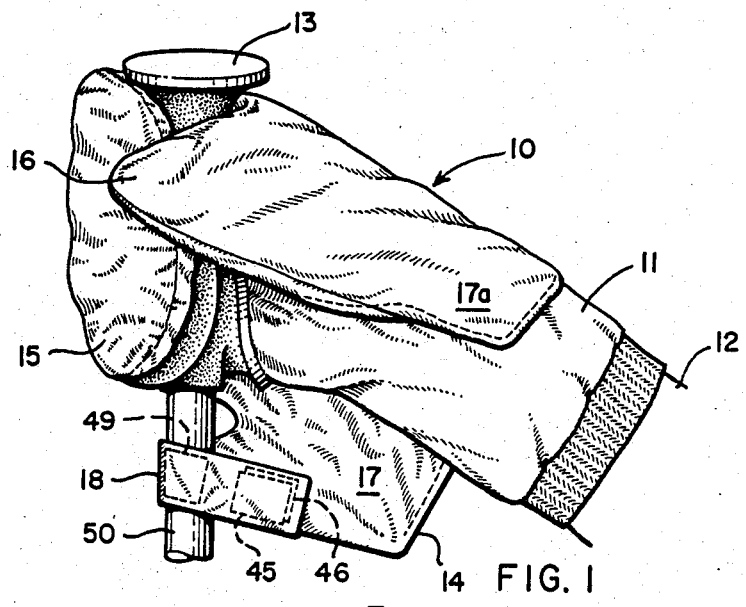
FIG. 1 shows a perspective view of the subject invention being worn over a ski glove, with the wearer gripping a ski pole.
Figure 3:
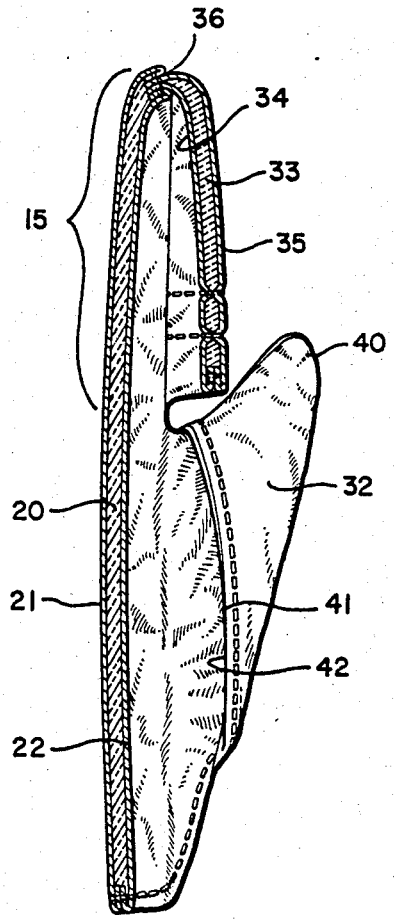
FIG. 3 is a cross section of the subject invention taken along the lines 3—3 of FIG. 2.
Figure 2:
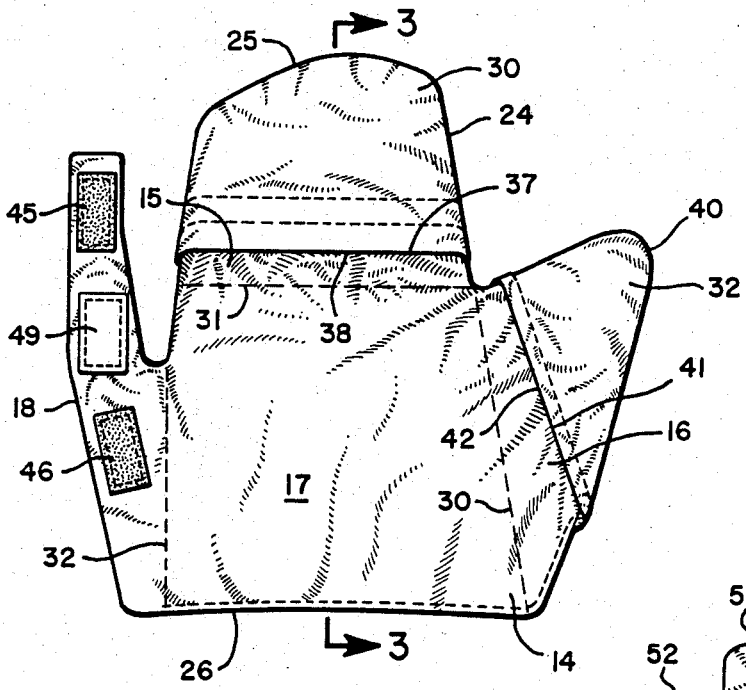
FIG. 2 is a plan view of the interior face of the subject glove covering.

Referring now to the drawings:

FIG. 1 discloses a glove covering 10 which is worn over a conventional ski glove 11 by a user 12 who is illustrated with a grip on a ski pole 13. One application of the present invention is to provide additional weather protection to the user by adding insulation and covering over a conventional ski glove 11. This covering includes an outer glove shell 14 which is divided into three parts. These parts include a finger section 15, a thumb section 16 and a palm/wrist section 17. A strap 18 extends from the palm/wrist section 17 and provides means for attachment of the glove 10 to a ski pole 13. FIGS. 2 and 3 provide greater detail of the subject glove shown in FIG. 1.

The primary structure of this glove covering comprises the outer glove shell 14 which forms the foundation to which the remaining structure is attached. The shell is configured in size and shape to cover the back side of the hand and/or ski glove for providing increased insulation and protection against the weather. Typically, this shell will comprise a layer of insulative material 20 which is sandwiched between exterior protective coverings 21 and 22. Typically these coverings will comprise a decorative fabric which is both sturdy and fashionable. The interior insulation 20 may be structured of THINSULATE (TM) or other materials which provide high insulative properties without extreme thickness. These three components are sewn together at a perimeter 24 to form a single, composite sheet or member.

This shell is generally divided into three sections, based upon the functional aspect of each particular section. Because of the functional definition of each of these three areas, it is not intended to segregate the covering into three actual boundary conditions. Instead, the division of the shell into three parts is to enable definition of three separate components of the glove covering to simplify further explanations in this disclosure. These three sections are provided in rough division by dashed lines 30, 31 and 32. Again, these dashed lines are figurative and do not actually mark a boundary for the specific three areas. However, the dashed lines are useful to perceive the definition applied to these respective areas as set forth in the claims hereafter.

The finger section 15 of the glove shell comprises that part of the shell which is positioned at the fingers of the glove or hand contained therein. Obviously, a clear demarcation of this border is unnecessary because hand sizes differ and will require differing dimensions for various sizes of gloves. Nevertheless, one skilled in the art will be able to identify that portion of the glove shell which comprises the finger section. It extends from a fingertip end 25 to line 31, or that area where the fingers meet the palm of the hand.

The thumb section 16 begins at line 30, representing the point where the thumb meets the palm of the hand and extends to a tip end 40 of the thumb-configured projecting part of the glove shell. The reminaing palm/-wrist section 17 comprises the general area within the dashed lines 30, 31 and 32. This area roughly conforms to an area slightly larger than the palm of the hand, meaning that portion of the hand not including fingers and thumb. Accordingly, the full length of the outer glove shell extends from a finger tip end 25 to a rearward wrist end 26 of the palm/wrist section. The additional structure to the left side of dashed line 32 in FIG. 2 represents a strap member 18 which is attached to the palm/wrist section 17 and extends outward therefrom to a length sufficient to wrap around a ski pole, as illustrated in FIG. 1. This strap member will be described in greater detail hereafter.

To enable the outer glove shell to be retained at the hand, and to provide further warmth and protection at the extremeties of fingers and thumb, first 30 and second 32 pocket members are attached. As illustrated in FIG. 3, the construction of the first pocket member 30 is similar to that of the outer glove shell. Specifically, it includes a thin sheet of insulation 33 which is sandwiched between opposing covering sheets of protective material 34 and 35.

This first pocket member is configured in the approximate shape of the finger section 15 and is joined at the contiguous perimeter edge 24 by stitching or other appropriate means of attachment. This point of attachment 36 is shown as a stitched or sewn construction in FIG. 3. One side of this first pocket member 37 is oriented transverse to the glove shell and is unattached thereto. Its orientation is proximate to the juncture 31 of the palm/wrist and finger sections. It operates to form a pocket 38 having an opening which is accessible for the fingers from the palm/wrist section of the shell. This pocket is also referred to herein as the finger pocket of the glove covering. This pocket is shown as attached across the total periphery of the glove shell, including forward finger tip end; however, total peripheral attachment is not essential. The total attachment at the periphery will, however, provide increased protection from cold weather.

Although dimensions will generally vary because of differences in hand and glove size, typical lengths for the finger section as compared to the total length of the glove shell will generally be less than one half. More particularly, this length of fingertip section from point 25 to opening 37 will approximately be one third the total length of the shell, provided the rearward end 26 extends several inches along the wrist of the wearer.

The second pocket member 32 or thumb member is configured in the approximate shape of the thumb section 16 of the glove shell and is likewise attached at the contiguous perimeter edge 40 of these two members. Likewise, one side 41 of the second pocket member is oriented transverse which respect to the approximate juncture of the palm/wrist and thumb sections 30 and is unattached to form a pocket opening 42 which is accessible from the palm/wrist section of the shell. This pocket, also referred to as a thumb pocket receives the thumb or thumb of the ski glove, and cooperates with the finger pocket 30 to retain the glove covering over the hand or ski glove. Although not shown in cross section, the second pocket member is constructed similar to the first pocket member 30. The length of the pocket would approximately equal the typical length of the thumb of a ski glove.

The remaining palm/wrist section 17 is formed as an open face of the interior side of the outer glove shell. It does not include any pocket structure and provides protection to the back side of the hand or ski glove. Its position is against the back side of the glove 11 as shown in FIG. 1. The width of this palm/wrist section is sufficient to partially wrap around the hand, thumb and wrist as the thumb is brought to a closed grasp of a ski pole as shown in FIG. 1. Section 17a is accordingly drawn across the wrist and interior face of the hand or glove or provide additional protection against weather and snow. In the illustrated embodiment, the length of the outer shell from tip 25 to rearward end 26 is approximately equal to the width measurement of the outer shell from the tip of the thumb 40 to juncture line 32.

A final section of the glove covering includes a quick attachment and release means 18. This comprises a strap member which has VELCRO (TM) attachment tabs 45 and 46 of respective loop and hook configuration. These are shown in coupled relationship in FIG. 1. These velcro tabs adapt the strap for quick release and attachment around the ski pole. In addition, a friction pad 49 is attached intermediate the velcro tabs to facilitate retention of a fixed, non-sliding position of the strap member 18 on the ski pole shaft 50 when in attached configuration. A rubberized polymer friction pad prevents the strap from creeping down the pole or otherwise drawing the glove covering away from its proper position. As used in this disclosure, strap is a broad term meaning any type of means capable of retaining the glove member around the ski pole in a releasable configuration.

Figure 4:
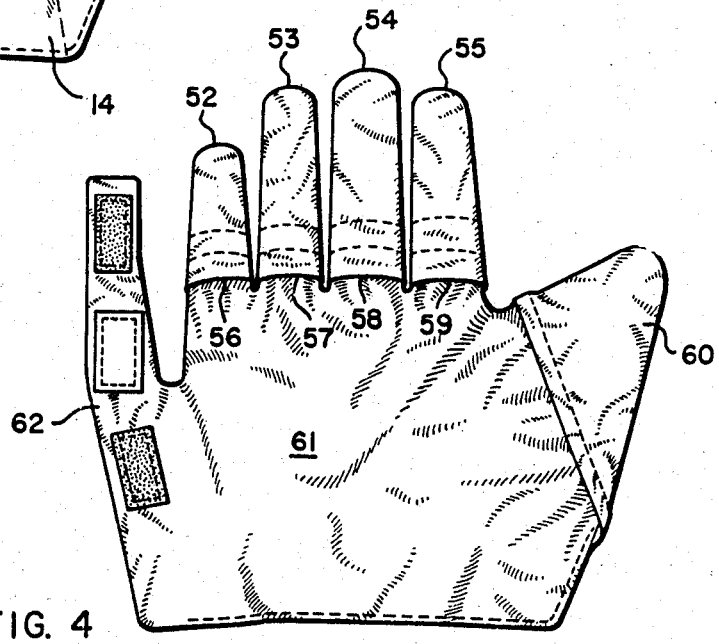
FIG. 4 is an alternate embodiment of the present invention showing separate finger inserts as opposed to a mitten configuation.

FIG. 4 discloses an alternate embodiment of the present invention. It includes a plurality of first pocket members 52, 53, 54, 55 configured in the approximate same shape as a corresponding finger section of the glove shell. In this instance, the glove shell has a fingered configuration as opposed to a mitten-type configuration. This finger section is attached to the four pocket members 52-55 around the contiguous perimeter edges to form pocket inserts for each respective finger of the hand. These finger pockets are sufficiently large to allow containment of a gloved hand, including both the finger and the finger of the ski glove, each first pocket member having one side 56, 57, 58, 59 respectively transverse and unattached with respect to the approximate juncture of the palm/wrist and finger sections to form a plurality of pocket openings. The thumb pocket 60 is configured in a manner similar to that described for thumb pocket 32 in FIG. 2.

The palm/wrist section 61 provides an open face covering across the back of the hand. The absence of glove structure across the palm of the hand enables the skier or other wearer to maintain a firm grip without increased bulk in material or insulation. This is significant for skiers who already have a heavy pair of ski gloves on their hands and desire additional protection without increasing the thickness of glove material between the hand and ski pole. Similarly, when the glove covering is worn without an interior conventional glove, the open palm permits ventilation to the hand on warm days while substantially protecting the hand against snow during a fall or other snow contact.

A quick release strap 62 is also provided and operated in a manner described for strap 18 in the previous figures. The use of this strap permits elimination of a wrist strap which is conventionally attached to the ski pole. It is well known that such wrist straps are dangerous because they do not permit release when a ski pole is caught in a chair lift, deep snow or in a tree. When the wrist strap fails to release, severe injury can occur to the skier's wrist or arm. The present quick release strap allows attachment of the ski pole to the ski glove during use. If the pole becomes caught, the quick release strap may pull free, or the glove itself may pull free from the hand of the wearer. The wrist and arm, however, are not injured because the glove is easily released from the hand-held position.

Other advantages and benefits of the present inventive structure will be apparent to those skilled in the art. For example, this new glove configuration offers increased versatility without any change of structure. The glove may be used as a protective shell outside a ski glove to increase the warmth of the extremities and back of the hand. On warm days, the glove may be used as a single covering for the hand of the user, providing both protection on the exterior side and ventilation to the palm side of the hand. Because of the sheet-like construction of the glove covering, very little bulk is developed. This enables the glove to be inserted easily in pockets of a jacket or otherwise stored without inconvenience. In addition, it will be apparent to those skilled in the art that modifications and alterations to this general concept are foreseeable, particularly as they relate to adaptation for certain styles of gloves and ski wear. In addition, this glove covering may be adapted for other winter sports and applications where a person's hands need to be protected from the weather, without increasing the bulk between the hand and the object being held. Accordingly, the previous disclosure is not to be construed as limiting, except as set forth in the following claims.

We claim:

1. A glove covering for use in winter sports for protecting a hand against cold weather, said glove comprising:

an outer glove shell configured in size and shape to fully cover only a back side of the hand and including at least one finger section, a palm/wrist section and a thumb section, and having a length extending from a forward finger -tip end of the finger section to a rearward wrist end of the palm/wrist section;

at least one first pocket member configured in the approximate shape of the finger section of the glove shell and being joined therewith at contiguous perimeter edges including the forward finger-tip end of the shell, one side of the first pocket member being transverse and unattached with respect to the approximate juncture of the palm/-wrist and finger sections to form a pocket opening accessible from the palm/wrist section of the shell, thereby forming a finger pocket between the shell and the first pocket member;

a second pocket member configured in the approximate shape of the the thumb section of the glove shell and being joined therewith at contiguous perimeter edges including a thumb-tip end of the shell, one side of the second pocket member being transverse and unattached with respect to the approximate juncture of the palm/wrist and thumb sections to form a pocket opening accessible from the palm/wrist section of the shell, thereby forming a thumb pocket between the shell and the second pocket member;

the palm/wrist section being formed as an open face without any pocket structure or protection to the hand except for the shell which is positioned against the back of the hand.

2. A glove as defined in claim 1, wherein said outer glove shell is comprised of a layer of insulative material sandwiched between layers of attached exterior protective covering.

3. A glove as defined in claim 1, further comprising a strap member attached to the palm/wrist section on an opposing side to the juncture of the palm/wrist section and extending outward therefrom, said strap member having sufficient length to wrap around a ski pole, thereby permitting the glove to be coupled directly to the ski pole.

4. A glove as defined in claim 3, further comprising quick attachment and release means coupled to the strap member and adapting the strap member for quick release and attachment to the ski pole.

5. A glove as defined in claim 3, further comprising a friction pad attached to the strap member on a contacting side thereof with the ski pole to facilitate retention of a fixed, nonsliding position of the strap member on the ski pole when in an attached configuration.

6. A glove as defined in claim 5, wherein the quick attachment and release means comprises opposing gripping faces of VELCRO(tm) material spaced on opposite sides of a polymer friction pad.

7. A glove as defined in claim 1, comprising a plurality of first pocket members configured in the approximate shape of the finger section of the glove shell and being joined therewith at contiguous perimeter edges, one side of each first pocket member being transverse and unattached with respect to the approximate juncture of the palm/wrist and finger section to form a plurality of pocket openings accessible from the palm/-wrist section of the shell, thereby forming a plurality of finger pockets between the shell and the first pocket members.

8. A glove as defined in claim 1, further comprising an interior ski glove having finger and thumb enclosures and a glove body for fully enclosing the hand, said finger enclosures of the interior glove being positioned within the first pocket, said thumb enclosure being positioned within the second pocket, and a palm side of the interior glove being exposed and uncovered to permit direct grasp of an object by a wearer of the interior glove and glove covering, an exterior side of the interior glove at the back of the hand being shielded from cold weather by the outer glove shell.

9. A glove as defined in claim 1, wherein the length of the finger section of the glove is less than half the total length of the glove shell from the finger-tip to the rearward end of the palm/wrist section.

10. A glove as defined in claim 9, wherein the length of the fingertip section is approximately one-third the total length of the shell.

11. A glove as defined in claim 9, wherein the length of the outer shell approximately equals a width measurement of the outer shell.

12. A glove as defined in claim 9, wherein the palm/-wrist section of the outer shell has sufficient width extending laterally with and rearward of the thumb section to provide a partial covering to a wearer's wrist when the wearer's hand is closed to a fist configuration, the thumb section being operable to draw the extended palm/wrist section around and over the wrist.

* * * * *